US010388226B2

(12) United States Patent
Hwang et al.

(10) Patent No.: US 10,388,226 B2
(45) Date of Patent: Aug. 20, 2019

(54) TEMPERATURE COMPENSATION CIRCUIT AND METHOD FOR A DISPLAY PANEL AND DISPLAY PANEL

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventors: Tai-jiun Hwang, Guangdong (CN); Zhenling Wang, Guangdong (CN)

(73) Assignee: SHENZHEN CHINA OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/742,232

(22) PCT Filed: Nov. 23, 2017

(86) PCT No.: PCT/CN2017/112475
§ 371 (c)(1),
(2) Date: Jan. 5, 2018

(87) PCT Pub. No.: WO2019/071735
PCT Pub. Date: Apr. 18, 2019

(65) Prior Publication Data

US 2019/0108792 A1 Apr. 11, 2019

(30) Foreign Application Priority Data

Oct. 11, 2017 (CN) ..... 2017 1 0949708

(51) Int. Cl.
*G09G 3/3258* (2016.01)

(52) U.S. Cl.
CPC ..... *G09G 3/3258* (2013.01); *G09G 2320/041* (2013.01)

(58) Field of Classification Search
CPC ..... G09G 3/3258; G09G 2320/041
(Continued)

(56) References Cited

U.S. PATENT DOCUMENTS

2013/0083000 A1 4/2013 Toyomura et al.
2014/0168041 A1 6/2014 Chen et al.
(Continued)

FOREIGN PATENT DOCUMENTS

CN 102654973 A 9/2012
CN 106409231 A 2/2017
(Continued)

*Primary Examiner* — Michael Pervan
(74) *Attorney, Agent, or Firm* — Hauptman Ham, LLP

(57) ABSTRACT

A temperature compensation circuit and method for a display panel and a display panel are provided. The display panel includes a control circuit, a driving circuit, a detection circuit and a pixel circuit; wherein the detection circuit is configured to obtain a current threshold voltage of a transistor of the pixel circuit, the control circuit obtains a current voltage difference between the current threshold voltage and an initial threshold voltage, obtains a current compensation gain matching the current voltage difference according to a predetermined related data of a voltage difference and a compensation gain, and controls the driving circuit to drive the pixel circuit by using the current compensation gain. By practice of the disclosure, the temperature compensation for a display panel could be achieved without the additional temperature sensor, so the service life of the display panel could be extended.

8 Claims, 3 Drawing Sheets

(58) Field of Classification Search
USPC ..... 345/101, 214
See application file for complete search history.

(56) References Cited

U.S. PATENT DOCUMENTS

| | | | |
|---|---|---|---|
| 2014/0176400 | A1 | 6/2014 | Park et al. |
| 2015/0154908 | A1 | 6/2015 | Nam et al. |
| 2016/0125811 | A1 | 5/2016 | Park et al. |

FOREIGN PATENT DOCUMENTS

| | | | |
|---|---|---|---|
| CN | 106935192 | A | 7/2017 |
| CN | 106991969 | A | 7/2017 |
| JP | 2000294154 | A | 10/2010 |
| KR | 20010039316 | A | 5/2001 |

TEMPERATURE COMPENSATION CIRCUIT AND METHOD FOR A DISPLAY PANEL AND DISPLAY PANEL

RELATED APPLICATIONS

The present application is a National Phase of International Application Number PCT/CN2017/112475, filed Nov. 23, 2017, and claims the priority of China Application No. 201710949708.5, filed Oct. 11, 2017.

FIELD OF THE DISCLOSURE

The disclosure relates to an organic light emitting diode display technical field, and more particularly to a temperature compensation circuit and method for a display panel and a display panel.

BACKGROUND

Compared with liquid crystal displays (LCDs), organic light emitting diode (OLED) devices have the advantages such as fast response, light weight, no limitation of viewing angle, high contrast ratio and so on, and the organic light emitting diode (OLEO) devices are considered as the main research focuses of the display panel in recent years. According to the driving method of the organic light emitting diode, it can be roughly divided into a passive organic light emitting diode (PMOLED) panel and an active organic light emitting diode (AMOLED) panel. Wherein AMOLED panel for high-resolution and large size display panel. The pixel brightness of AMOLED panel is proportional to the conduction current of the organic light-emitting diode, and the amount of the conduction current is determined by the transistor. In the practice process, the temperature of the AMOLED panel increases, the threshold voltage of the transistor will gradually reduce, and the driving current of the transistor for driving the organic light-emitting diode is increased, so that the conduction current flowing through the organic light-emitting diode is increased. However, the AMOLED panel contains a large amount of organic materials to deteriorate the AMOLED panel under high temperature and high current conditions easily, thereby shortening the service life of the AMOLED panel.

In order to solve the above technical problem, the prior art approach is to set a temperature sensor on the AMOLED panel. The temperature sensor detects the working temperature of the AMOLED panel and feedback to the control circuit, the control circuit reduces the conduction current through the organic light-emitting diode by reducing the driving current of the transistor uniformly to achieve the purpose for extending the service life of the AMOLED panel by the temperature compensation for the AMOLED panel.

However, an additional temperature sensor needs to be added for the temperature compensation in the prior art, so the production cost of the display panel will be increased.

SUMMARY

A technical problem to be solved by the disclosure is to provide a temperature compensation circuit and method for a display panel and a display panel, so the temperature compensation of the display panel can be realized without an additional temperature sensor so as to extend the service life of the display panel.

To achieve the above object, according to one aspect, the embodiment of the disclosure provides a temperature compensation circuit for a display panel, including:

a control circuit; and a detection circuit, electrically coupled to the control circuit; wherein the control circuit is configured to be electrically coupled to a driving circuit of the display panel, the detection circuit is configured to be electrically coupled to a pixel circuit of the display panel to obtain a current threshold voltage of a transistor of the pixel circuit, the control circuit further obtains a current voltage difference between the current threshold voltage and an initial threshold voltage, obtains a current compensation gain matching the current voltage difference according to a predetermined related data of a voltage difference and a compensation gain, and controls the driving circuit to drive the pixel circuit by using the current compensation gain to compensate an impact of temperature variation on the pixel circuit; wherein after the control circuit obtained the current voltage difference between the current threshold voltage and the initial threshold voltage, further determines whether the current voltage difference is less than zero, if and only if the current voltage difference is less than zero, obtains the current compensation gain matching the current voltage difference according to the predetermined related data of the voltage difference and the compensation gain; wherein the related data of predetermined voltage difference and compensation gain is obtained by the following steps, including: obtaining a relation between a threshold voltage of the transistor of the pixel circuit and a temperature, and a relation between a mobility of the transistor of the pixel circuit and the temperature by experiment, establishing the predetermined related data of the temperature, the voltage difference and the compensation gain, wherein the compensation gain is obtained through a combination of the threshold voltage, the mobility and the temperature.

To achieve the above object, according to another aspect, the embodiment of the disclosure provides a display panel, including:

a control circuit, a driving circuit, a detection circuit and a pixel circuit;

wherein the control circuit, the driving circuit and the pixel circuit are sequentially electrically coupled, the detection circuit respectively electrically couple to the control circuit and the pixel circuit to obtain a current threshold voltage of a transistor of the pixel circuit, the control circuit obtains a current voltage difference between the current threshold voltage and an initial threshold voltage, obtains a current compensation gain matching the current voltage difference according to a predetermined related data of a voltage difference and a compensation gain, and controls the driving circuit to drive the pixel circuit by using the current compensation gain to compensate an impact of temperature variation on the pixel circuit. To achieve the above object, according to another aspect, the embodiment of the disclosure provides a temperature compensation method for a display panel, including:

obtaining a current threshold voltage of a transistor of a pixel circuit;

obtaining a current voltage difference between the current threshold voltage and an initial threshold voltage;

obtaining a current compensation gain matching the current voltage difference according to a predetermined related data of a voltage difference and a compensation gain;

controlling the driving circuit to drive the pixel circuit by using the current compensation gain to compensate an impact of temperature variation on the pixel circuit.

The beneficial effects of the disclosure are as follows, a temperature compensation circuit and method for a display panel and a display panel provided by the disclosure obtain a current threshold voltage of a transistor of the pixel circuit, further obtain a current voltage difference between the current threshold voltage and an initial threshold voltage, then obtain a current compensation gain matching the current voltage difference according to a predetermined related data of a voltage difference and a compensation gain, and controls the driving circuit to drive the pixel circuit by using the current compensation gain. By practice of the disclosure, the temperature compensation for a display panel could be achieved without the additional temperature sensor, so the service life of the display panel could be extended.

DETAILED DESCRIPTION OF PREFERRED EMBODIMENTS

Figure 1:
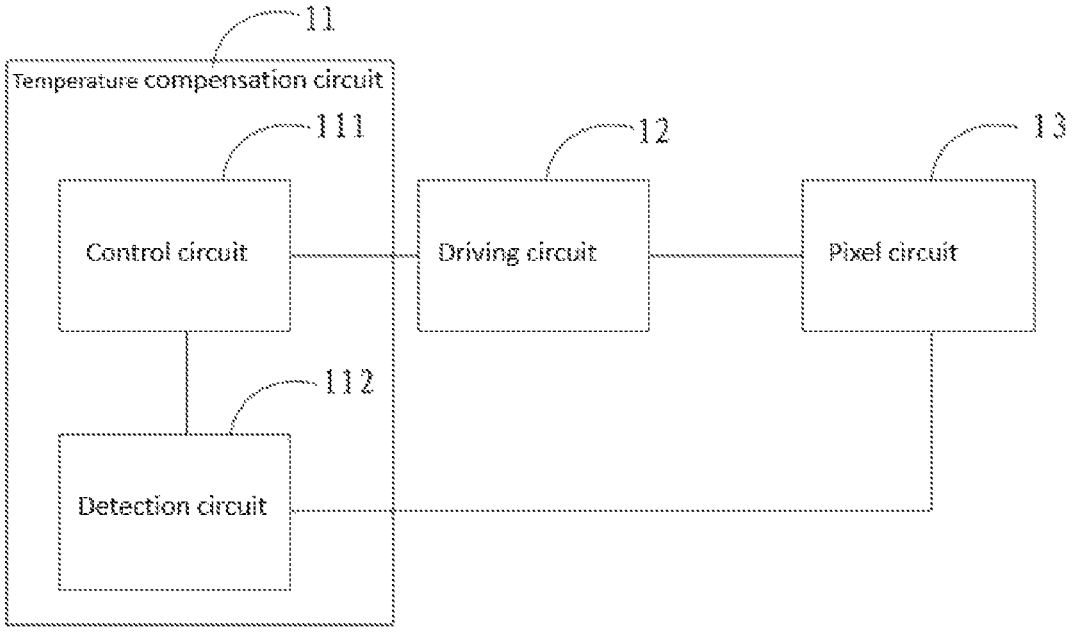
FIG. 1 is a structural schematic view of a display panel according to an embodiment of the disclosure.

Certain terms are used throughout the following descriptions and claims to refer to particular system components. As one skilled in the art will appreciate, manufacturers may refer to a component by different names. This document does not intend to distinguish between components that differ in name but not function. The disclosure is described in detail below with references to the accompanying drawings and specific embodiments, FIG. 1 is a structural schematic view of a display panel according to an embodiment of the disclosure. As shown in FIG. 1, the display panel includes a temperature compensation circuit 11, a driving circuit 12 and a pixel circuit 13, wherein the temperature compensation circuit 11 includes a control circuit 111 and a detection circuit 112.

The control circuit 111, the driving circuit 112 and the pixel circuit 13 are sequentially electrically coupled, the detection circuit 112 respectively electrically couple to the control circuit 111 and the pixel circuit 13.

Figure 2:
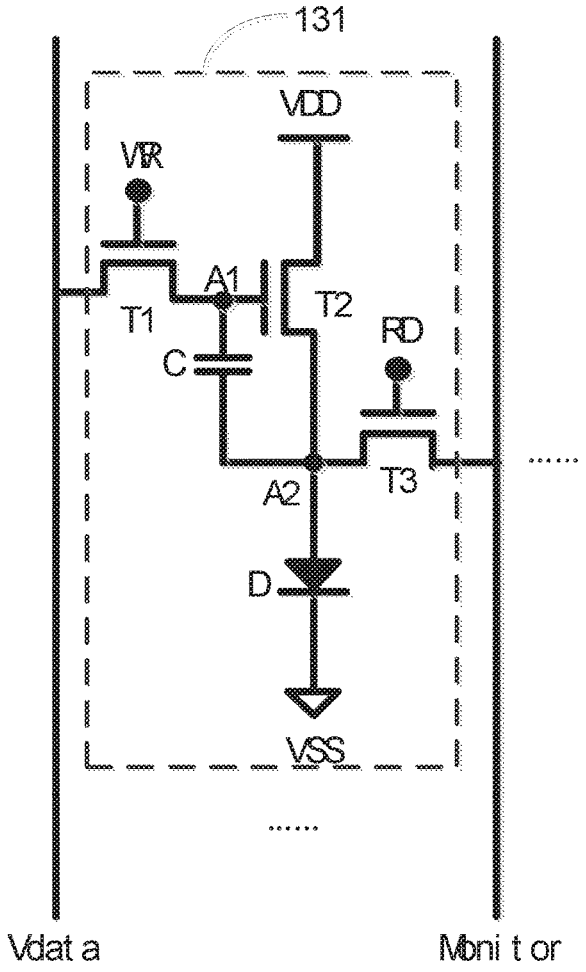
FIG. 2 is a circuit diagram of the pixel driving circuit of the display panel in FIG. 1.

Specifically, please refer to FIG. 2, FIG. 2 is a circuit diagram of the pixel driving circuit of the display panel in FIG. 1. As shown in FIG. 2, the pixel circuit 13 includes a plurality of sub-pixel driving circuits 131 arranged in matrix, each of the sub-pixel driving circuits 131 includes a first transistor T1, a second transistor T2, a third transistor T3, a storage capacitor C and an organic light emitting diode D.

Wherein, a gate of the first transistor T1 electrically connects to a first control signal line WR, a source of the first transistor electrically connects to a data signal line Vdata, a drain of the first transistor electrically connects to a first node A1; a gate of the second transistor T2 electrically connects to the first node A1, a source of the second transistor T2 electrically connects to a second node A2, a drain of the second transistor T2 connects to a positive voltage of a power source VDD; a gate of the third transistor T3 electrically connects to a second control signal line RD, a source of the third transistor T3 electrically connects to the second node A2, a drain of the third transistor T3 electrically connects to a detection signal line Monitor; an end of the storage capacitor C electrically connects to the first node A1, another end of the storage capacitor C electrically connects to the second node A2; an anode of the organic light emitting diode D electrically connects to the second node A2, a cathode of the organic light emitting diode D electrically connects to a negative voltage of the power source Vss.

Wherein, the first control signal line WR, the data signal line Vdata and the second signal line RD respectively electrically connect to the driving circuit 12, the detection signal line Monitor and the detection circuit 112.

Wherein, the control circuit 111, the detection circuit 112 and the driving circuit 12 are circuit modules in an existing timing controller (TCON). Those skilled in the art can understand that the timing controller is mainly composed of a timing generator, a display memory, a management circuit and a control circuit, and the temperature compensation function is realized by using the existing timing controller without adding extra hardware cost.

The detection circuit 112 is configured to obtain a current threshold voltage Vth of the transistor of the pixel circuit 13. Specifically, the detection circuit 112 obtains the current threshold voltage Vth of the driving transistor, i.e. the second transistor T2 of each of the sub-pixel driving circuits 131 through the detection signal line Monitor.

Specifically, When the first transistor T1 and the third transistor T3 are turned on at the same time, the data voltage signal applied to the data signal line Vdata and the reference voltage signal applied to the detection signal line Monitor are written into both ends of the storage capacitor C respectively. At this moment, the second transistor T2 turns on. Then, the reference voltage signal is disconnected, and the current charges the parasitic capacitance of the detection signal line Monitor through the third transistor T3 until the voltage difference across the storage capacitor C is the current threshold voltage Vth, the second transistor T2 is turned off. In this moment, the detection circuit 112 reads the voltage on the detection signal line Monitor as the current threshold voltage Vth of the driving transistor.

The control circuit 111 obtains a current voltage difference ΔVth between the current threshold voltage Vth and an initial threshold voltage Vth0, obtains a current compensation gain G matching the current voltage difference ΔVth according to a predetermined related data of a voltage difference ΔVth and a compensation gain G, and controls the driving circuit 12 to drive the pixel circuit 13 by using the current compensation gain G to compensate an impact of temperature variation on the pixel circuit 13.

Selectively, the related data of predetermined voltage difference and compensation gain is obtained by the following steps, including: obtaining a relation between a threshold voltage of the transistor of the pixel circuit 13 and a temperature, and a relation between a mobility of the transistor of the pixel circuit 13 and the temperature by experiment, establishing the predetermined related data of the temperature, the voltage difference and the compensation gain, wherein the compensation gain is obtained through a combination of the threshold voltage, the mobility and the temperature.

Figure 3:
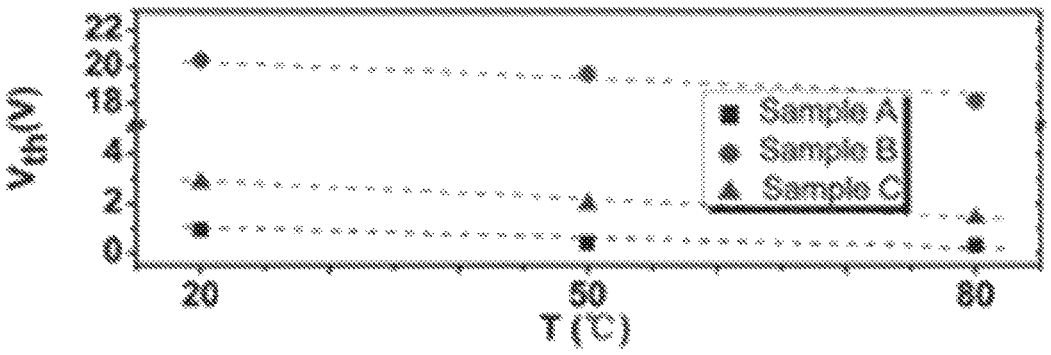
FIG. 3 is a graph showing a relation between threshold voltage and temperature of the transistor of the pixel circuit.

Please refer to FIG. 3, FIG. 3 is a graph showing a relation between threshold voltage and temperature of the transistor of the pixel circuit. As shown in FIG. 3, the horizontal axis T represents the temperature, the vertical axis Vth represents the threshold voltage, the transistors are Sample A, Sample B and Sample C.

As shown in FIG. 3, with the increase of temperature T, the threshold voltage Vth of Sample A, Sample B and Sample C is decreasing.

Figure 4:
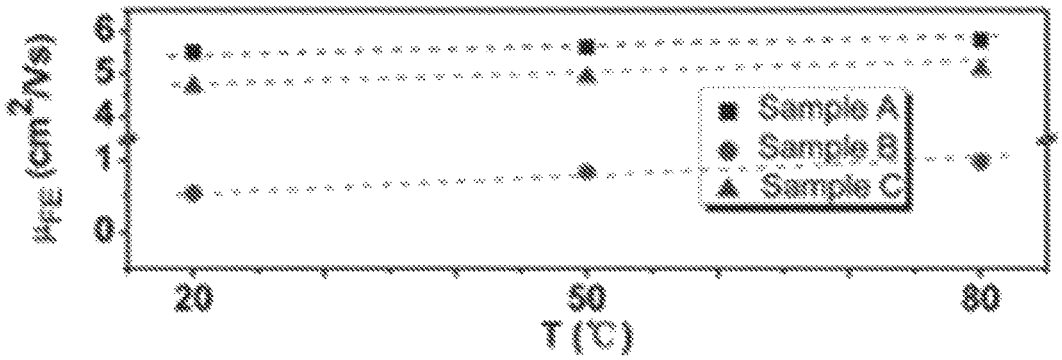
FIG. 4 is a graph showing a relation between mobility and temperature of the transistor of the pixel circuit.

Please refer to FIG. 4, FIG. 4 is a graph showing a relation between mobility and temperature of the transistor of the pixel circuit. As shown in FIG. 4, the horizontal axis T represents the temperature, the vertical axis $\mu_{FE}$ represents the mobility, the transistors are Sample A, Sample B and Sample C.

As shown in FIG, 4, with the increase of temperature T, the mobility $\mu_{FE}$ of Sample A, Sample B and Sample C is increasing.

Wherein, the variation of the threshold voltage of the transistor under different operating temperatures can be estimated, i.e. a predetermined related data of a voltage difference and a compensation gain to form a look-up table by experimentally measuring the threshold voltage and the temperature of the transistor in the pixel circuit and the relationship between the mobility and the temperature.

Selectively, after the control circuit 111 obtained the current voltage difference ΔVth between the current threshold voltage Vth and the initial threshold voltage Vth0, further determines whether the current voltage difference ΔVth is less than zero, if and only if the current voltage difference ΔVth is less than zero, obtains the current compensation gain G matching the current voltage difference ΔVth according to the predetermined related data of the voltage difference ΔVth and the compensation gain G.

Those skilled in the art can understand that when the current voltage difference ΔVth is less than zero, it indicates that the temperature of the transistor in the pixel circuit 13 is increasing, that is, temperature compensation is needed. On the other hand, when the current voltage difference ΔVth is greater than or equal to zero, the temperature of the transistor in the pixel circuit 13 is decreased or remains unchanged, that is, no temperature compensation is required at this time.

Figure 5:
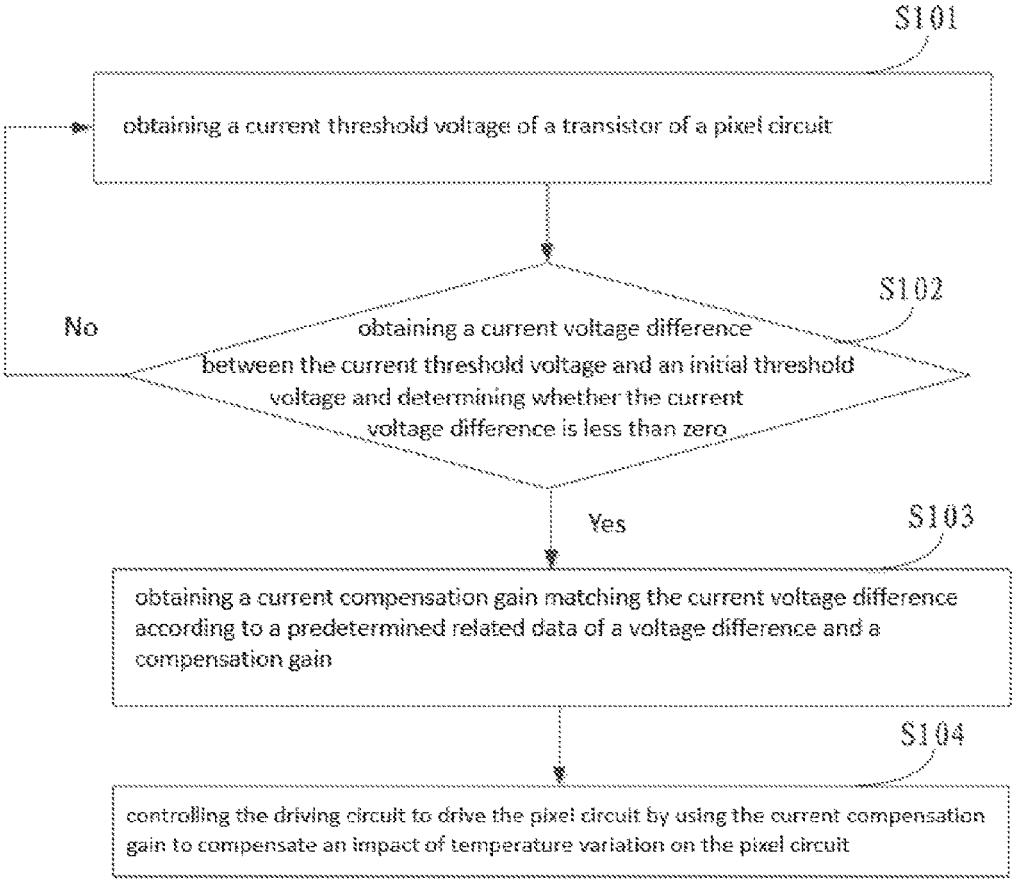
FIG. 5 is a flow chart diagram of a temperature compensation method for a display panel according to an embodiment of the disclosure.

FIG. 5 is a flow chart diagram of a temperature compensation method for a display panel according to an embodiment of the disclosure. It should be noted that if the results are substantially the same, the method of the disclosure is not limited to the sequence shown in FIG. 5. As shown in FIG. 5, the method includes the following steps:

Step S101: obtaining a current threshold voltage of a transistor of a pixel circuit.

In step S101, the pixel circuit includes a plurality of sub-pixel driving circuits arranged in matrix, wherein each of the sub-pixel driving circuits is configured to drive corresponding organic light emitting diode in the display panel, each of the sub-pixel driving circuits includes a transistor configured to drive corresponding organic light emitting diode.

Wherein, obtaining the current threshold voltage of the transistor in the pixel circuit of the display panel is also obtaining the current threshold voltage of the transistor driving each organic light emitting diode in the display panel respectively.

Step S102: obtaining a current voltage difference between the current threshold voltage and an initial threshold voltage, and determining whether the current voltage difference is less than zero, if yes, step S103 is executed; otherwise, step S101 is executed.

In step S102, if the current voltage difference ΔVth is less than zero, it indicates that the temperature of the transistor driving the organic light emitting diode is increasing, that is, temperature compensation is needed. On the other hand, when the current voltage difference ΔVth is greater than or equal to zero, the temperature of the transistor driving the organic light emitting diode is decreased or remains unchanged, that is, no temperature compensation is required at this time.

Those skilled in the art can understand that since the pixel circuit includes a plurality of sub-pixel driving circuits arranged in matrix, three different situations will occur: the current voltage differences of the transistors in all the sub-pixel driving circuits in the pixel circuit are all less than zero, or the current voltage differences of the transistors in all the sub-pixel driving circuits in the pixel circuit are all greater than or equal to zero, or the current voltage difference of the transistors in the partial sub-pixel driving circuits in the pixel circuit is less than zero and the current voltage difference of the transistors in the remaining sub-pixel driving circuit is greater than or equal to zero.

In other words, there are three different situations when temperature compensation is performed: temperature compensation is performed on all the transistors driving the organic light emitting diodes in the display panel, or temperature compensation of the transistors driving the organic light emitting diodes in the display panel is not required, or temperature compensation is performed on the partial transistors driving the organic light emitting diodes in the display panel and the remaining transistors the organic light emitting diodes do not need temperature compensation.

Step S103: obtaining a current compensation gain matching the current voltage difference according to a predetermined related data of a voltage difference and a compensation gain.

In step S103, the related data of predetermined voltage difference and compensation gain is obtained by the following steps, including: obtaining a relation between a threshold voltage of the transistor of the pixel circuit and a temperature, and a relation between a mobility of the transistor of the pixel circuit and the temperature by experiment, establishing the predetermined related data of the temperature, the voltage difference and the compensation gain, wherein the compensation gain is obtained through a combination of the threshold voltage, the mobility and the temperature.

Step S104: controlling the driving circuit to drive the pixel circuit by using the current compensation gain to compensate an impact of temperature variation on the pixel circuit.

In step S104, since the driving current of driving the sub-pixel is related to the data signal voltage, so this feature can be used to adjust the amount of the driving current to achieve the technical effect of compensating for the impact of the temperature variation on the pixel circuit.

Take the circuit diagram shown in FIG. 2 as an example, when the driving current is adjusted by the data signal voltage, the step of controlling the driving circuit to drive the pixel circuit by using the current compensation gain specifically includes: the reduced data signal voltage is applied to the gate of the first transistor T1 in the corresponding sub-pixel driving circuit according to the data signal voltage reduced by the current compensation gain. Wherein, because the voltage of the data signal at the gate of the first transistor T1 is decreased, when the first transistor T1 is turned on, the gate voltage of the second transistor T2 becomes lower. Because the gate voltage of the second transistor is lower, the driving current generated by the second transistor T2 for driving the organic light emitting diode D is reduced, so that the temperature compensation is realized.

The beneficial effects of the disclosure are as follows, a temperature compensation circuit and method for a display panel and a display panel provided by the disclosure obtain a current threshold voltage of a transistor of the pixel circuit, further obtain a current voltage difference between the current threshold voltage and an initial threshold voltage, then obtain a current compensation gain matching the current voltage difference according to a predetermined related data of a voltage difference and a compensation gain, and controls the driving circuit to drive the pixel circuit by using the current compensation gain. By practice of the disclosure, the temperature compensation for a display panel could be achieved without the additional temperature sensor, so the service life of the display panel could be extended. In addition, the disclosure can realize the temperature compensation for the single transistor for driving the organic light-emitting diodes in the display panel respectively, so as to improve the precision of the temperature compensation, and the compensation effect is better.

The foregoing contents are detailed description of the disclosure in conjunction with specific preferred embodiments and concrete embodiments of the disclosure are not limited to these descriptions. For the person skilled in the art of the disclosure, without departing from the concept of the disclosure, simple deductions or substitutions can be made and should be included in the protection scope of the application.

What is claimed is:

1. A temperature compensation circuit for a display panel, comprising:

a control circuit; and a detection circuit, electrically coupled to the control circuit;

wherein the control circuit is configured to be electrically coupled to a driving circuit of the display panel, the detection circuit is configured to be electrically coupled to a pixel circuit of the display panel to obtain a current threshold voltage of a transistor of the pixel circuit, the control circuit further obtains a current voltage difference between the current threshold voltage and an initial threshold voltage, obtains a current compensation gain matching the current voltage difference according to a predetermined related data of a voltage difference and a compensation gain, and controls the driving circuit to drive the pixel circuit by using the current compensation gain to compensate an impact of temperature variation on the pixel circuit;

wherein after the control circuit obtained the current voltage difference between the current threshold voltage and the initial threshold voltage, further determines whether the current voltage difference is less than zero, if the current voltage difference is less than zero, obtains the current compensation gain matching the current voltage difference according to the predetermined related data of the voltage difference and the compensation gain, and if the current voltage difference is greater than or equal to zero, the compensation gain is not required;

wherein the related data of predetermined voltage difference and compensation gain is obtained by the following steps, comprising: obtaining a relation between a threshold voltage of the transistor of the pixel circuit and a temperature, and a relation between a mobility of the transistor of the pixel circuit and the temperature by experiment, establishing the predetermined related data of the temperature, the voltage difference and the compensation gain, wherein the compensation gain is obtained through a combination of the threshold voltage, the mobility and the temperature.

2. A display panel, comprising:

a control circuit, a driving circuit, a detection circuit and a pixel circuit;

wherein the control circuit, the driving circuit and the pixel circuit are sequentially electrically coupled, the detection circuit respectively electrically couple to the control circuit and the pixel circuit to obtain a current threshold voltage of a transistor of the pixel circuit, the control circuit obtains a current voltage difference between the current threshold voltage and an initial threshold voltage, obtains a current compensation gain matching the current voltage difference according to a predetermined related data of a voltage difference and a compensation gain, and controls the driving circuit to drive the pixel circuit by using the current compensation gain to compensate an impact of temperature variation on the pixel circuit;

wherein after the control circuit obtained the current voltage difference between the current threshold voltage and the initial threshold voltage, further determines whether the current voltage difference is less than zero, if the current voltage difference is less than zero, obtains the current compensation gain matching the current voltage difference according to the predetermined related data of the voltage difference and the compensation gain, and if the current voltage difference is greater than or equal to zero, the compensation gain is not required.

3. The display panel according to claim 2, wherein the related data of predetermined voltage difference and compensation gain is obtained by the following method, comprising: obtaining a relation between a threshold voltage of the transistor of the pixel circuit and a temperature, and a relation between a mobility of the transistor of the pixel circuit and the temperature by experiment, establishing the predetermined related data of the temperature, the voltage difference and the compensation gain, wherein the compensation gain is obtained through a combination of the threshold voltage, the mobility and the temperature.

4. The display panel according to claim 3, wherein the pixel circuit includes a plurality of sub-pixel driving circuits arranged in matrix, each of the sub-pixel driving circuits includes a first transistor, a second transistor, a third transistor, a storage capacitor and an organic light emitting diode;

wherein a gate of the first transistor electrically connects to a first control signal line, a source of the first transistor electrically connects to a data signal line, a drain of the first transistor electrically connects to a first node; a gate of the second transistor electrically connects to the first node, a source of the second transistor electrically connects to a second node, a drain of the second transistor connects to a positive voltage of a power source; a gate of the third transistor electrically connects to a second control signal line, a source of the third transistor electrically connects to the second node, a drain of the third transistor electrically connects to a detection signal line; an end of the storage capacitor electrically connects to the first node, another end of the storage capacitor electrically connects to the second node; an anode of the organic light emitting diode electrically connects to the second node, a cathode of the organic light emitting diode electrically connects to a negative voltage of the power source;

wherein the first control signal line, the data signal line and the second signal line respectively electrically connect to the driving circuit, the detection signal line and the detection circuit.

5. The display panel according to claim 2, wherein the pixel circuit includes a plurality of sub-pixel driving circuits arranged in matrix, each of the sub-pixel driving circuits includes a first transistor, a second transistor, a third transistor, a storage capacitor and an organic light emitting diode;

wherein a gate of the first transistor electrically connects to a first control signal line, a source of the first transistor electrically connects to a data signal line, a drain of the first transistor electrically connects to a first node; a gate of the second transistor electrically connects to the first node, a source of the second transistor electrically connects to a second node, a drain of the second transistor connects to a positive voltage of a power source; a gate of the third transistor electrically connects to a second control signal line, a source of the third transistor electrically connects to the second node, a drain of the third transistor electrically connects to a detection signal line; an end of the storage capacitor electrically connects to the first node, another end of the storage capacitor electrically connects to the second node; an anode of the organic light emitting diode electrically connects to the second node, a cathode of the organic light emitting diode electrically connects to a negative voltage of the power source;

wherein the first control signal line, the data signal line and the second signal line respectively electrically connect to the driving circuit, the detection signal line and the detection circuit.

6. The display panel according to claim 2, wherein the pixel circuit includes a plurality of sub-pixel driving circuits arranged in matrix, each of the sub-pixel driving circuits includes a first transistor, a second transistor, a third transistor, a storage capacitor and an organic light emitting diode;

wherein a gate of the first transistor electrically connects to a first control signal line, a source of the first transistor electrically connects to a data signal line, a drain of the first transistor electrically connects to a first node; a gate of the second transistor electrically connects to the first node, a source of the second transistor electrically connects to a second node, a drain of the second transistor connects to a positive voltage of a power source; a gate of the third transistor electrically connects to a second control signal line, a source of the third transistor electrically connects to the second node, a drain of the third transistor electrically connects to a detection signal line; an end of the storage capacitor electrically connects to the first node, another end of the storage capacitor electrically connects to the second node; an anode of the organic light emitting diode electrically connects to the second node, a cathode of the organic light emitting diode electrically connects to a negative voltage of the power source;

wherein the first control signal line, the data signal line and the second signal line respectively electrically connect to the driving circuit, the detection signal line and the detection circuit.

7. A temperature compensation method for a display panel, comprising:

obtaining a current threshold voltage of a transistor of a pixel circuit;

obtaining a current voltage difference between the current threshold voltage and an initial threshold voltage;

obtaining a current compensation gain matching the current voltage difference according to a predetermined related data of a voltage difference and a compensation gain;

controlling the driving circuit to drive the pixel circuit by using the current compensation gain to compensate an impact of temperature variation on the pixel circuit;

wherein after obtaining the current voltage difference between the current threshold voltage and the initial threshold voltage, the temperature compensation method for a display panel further comprises:

determining whether the current voltage difference is less than zero, if the current voltage difference is less than zero, obtaining the current compensation gain matching the current voltage difference according to the predetermined related data of the voltage difference and the compensation gain, and if the current voltage difference is greater than or equal to zero, the compensation gain is not required.

8. The temperature compensation method for a display panel according to claim 7, wherein the related data of predetermined voltage difference and compensation gain is obtained by the following steps, comprising:

obtaining a relation between a threshold voltage of the transistor of the pixel circuit and a temperature, and a relation between a mobility of the transistor of the pixel circuit and the temperature by experiment, establishing the predetermined related data of the temperature, the voltage difference and the compensation gain, wherein the compensation gain is obtained through a combination of the threshold voltage, the mobility and the temperature.

* * * * *